US009004608B1

(12) United States Patent
Charbonneau

(10) Patent No.: US 9,004,608 B1
(45) Date of Patent: Apr. 14, 2015

(54) ICE PULVERIZING KNIFE AND ICE PULVERIZING DEVICE COMPRISING AN ICE PULVERIZING KNIFE

(71) Applicant: Guy Charbonneau, Lachute (CA)

(72) Inventor: Guy Charbonneau, Lachute (CA)

( * ) Notice: Subject to any disclaimer, the term of this patent is extended or adjusted under 35 U.S.C. 154(b) by 0 days.

(21) Appl. No.: 14/263,102

(22) Filed: Apr. 28, 2014

(51) Int. Cl.
*F25C 5/04* (2006.01)

(52) U.S. Cl.
CPC ..... *F25C 5/04* (2013.01)

(58) Field of Classification Search
CPC ..... F25C 5/04
USPC ..... 144/220; 175/18; 37/222, 223; 299/24, 299/25, 41.1
See application file for complete search history.

(56) References Cited

U.S. PATENT DOCUMENTS

| | | | | |
|---|---|---|---|---|
| 2,393,282 | A * | 1/1946 | Berlin | 175/18 |
| 2,723,835 | A * | 11/1955 | Reese et al. | 175/18 |
| 3,382,935 | A * | 5/1968 | Watts | 175/313 |
| 3,672,785 | A * | 6/1972 | Byrne | 8/206 |
| 4,458,949 | A * | 7/1984 | Jury | 299/41.1 |
| 4,924,951 | A * | 5/1990 | Paulson | 175/57 |
| 7,131,506 | B2 * | 11/2006 | Hamilton et al. | 175/403 |
| 8,118,370 | B2 * | 2/2012 | Portmann et al. | 299/41.1 |
| 2004/0084215 | A1 * | 5/2004 | Lu | 175/18 |

* cited by examiner

*Primary Examiner* — John Kreck

(57) ABSTRACT

An ice pulverizing knife comprises a frame and a plurality of blades. The frame has a substantially circular base and comprises a top, a base and at least one opening. The top has a socket adapted for mechanically coupling the frame with a vertical drive shaft. Rotation of the vertical drive shaft results in rotation of the frame. The base engages with ice on a ground surface. The at least one opening is positioned between the top and the base. The plurality of blades is secured to the frame. Each blade radially projects from the frame and engages with the ice on the ground surface for cutting the ice. Ice cut by the blade and accumulated inside the frame is expelled from the frame through the at least one opening. An ice pulverizing device is equipped with the ice pulverizing knife.

19 Claims, 11 Drawing Sheets

990

990

ICE PULVERIZING KNIFE AND ICE PULVERIZING DEVICE COMPRISING AN ICE PULVERIZING KNIFE

TECHNICAL FIELD

The present disclosure relates to the field of ground surface de-icing. More particularly, the present disclosure relates to an ice pulverizing knife for pulverizing ice from a ground surface, and to an ice pulverizing device comprising an ice pulverizing knife.

BACKGROUND

Keeping ground surfaces, particularly roads and airport runways, free of ice has long been a major problem in geographical regions where temperatures drop below freezing. Over the years, many methods and devices have been developed and constructed to clear such ground surfaces of ice.

Some methods of clearing ground surfaces of ice include scarifying the ice, which consists in cutting grooves into the ice to increase the surface area that is exposed to warming rays of the sun. Numerous devices with rake attachments or cutter blades are known for scarifying or raking ground surfaces. However, in many cases, such methods do not provide the desired result quickly enough since the ice is not completely removed, but merely scarred, and the sun has to perform the remaining of the work.

Another method consists in melting the ice through a chemical reaction. Chemical methods of de-icing ground surfaces include spraying a de-icing fluid or scattering de-icing crystals or solids over the ice-covered surface. One common disadvantage of these two methods is that, as the ice melts, the water flows toward low-lying areas, entraining the de-icing chemicals with it. This effectively removes the de-icing chemicals from high-lying areas. Therefore, to gain efficiency, the chemical method needs to be combined with the scarifying method, which grooves tend to retain the chemicals. A consequent drawback is that some chemicals, such as salt, do not perform properly when temperatures are too cold. Furthermore, when the ice melts and water runs on the side of the road or runway, the water transporting the chemicals is absorbed by the surrounding ground, which may be detrimental to the environment.

Still another method consists in using various types of devices having ice cutting and/or ice crushing capabilities for removing ice from the ground, without assistance from warming rays of the sun or from chemicals. However, such devices usually do not have the capability to treat surfaces covered by very hard ice. For instance, some devices cannot operate at all when the ice is too hard and/or too thick. Other devices are only capable of removing a partial layer of ice when the ice is too hard, thus leaving a remaining layer of ice on the ground. Such devices need to treat the same surface of ice several times, in order to completely remove a layer of ice covering that surface.

There is therefore a need for an ice pulverizing knife and an ice pulverizing device comprising an ice pulverizing knife.

SUMMARY

According to a first aspect, the present disclosure provides an ice pulverizing knife for pulverizing ice from a ground surface. The knife comprises a frame and a plurality of blades secured to the frame. The frame has a substantially circular base and comprises a top having a socket. The socket is adapted for mechanically coupling the frame with a vertical drive shaft. A rotation of the vertical drive shaft results in a circular rotation of the frame. The frame also comprises the base for engaging with the ice on the ground surface. The frame further comprises at least one opening between the top and the base. Each blade partially extends outside the frame and partially extends inside the frame. A bottom surface of each blade engages with the ice on the ground surface for cutting the ice. Ice cut by the portion of each blade partially extending inside the frame is evacuated from the frame through the at least one opening.

According to a second aspect, the present disclosure provides an ice pulverizing device for pulverizing ice from a ground surface. The ice pulverizing device comprises at least one ice pulverizing knife and a propulsion mechanism. The propulsion mechanism comprises the vertical shaft. The socket of the at lest one ice pulverizing knife is mechanically coupled with the vertical drive shaft in such a manner that upon rotation of the vertical drive shaft, the at least one ice pulverizing knife rotates.

DETAILED DESCRIPTION

The foregoing and other features will become more apparent upon reading of the following non-restrictive description of illustrative embodiments thereof, given by way of example only with reference to the accompanying drawings. Like numerals represent like features on the various drawings.

Various aspects of the present disclosure generally address one or more of the problems related to ground surface de-icing.

Reference is now made to FIGS. 1A, 1B, and 2-8 concurrently, which illustrate an ice pulverizing knife 10 for pulverizing ice from a ground surface.

The knife 10 comprises a frame 20. The frame 20 comprises a substantially circular base 30. Although shown as being perfectly circular on the Figures, the present ice pulverizing knife 10 could alternately have another type of symmetric shape, such as for example an hexagon, a heptagon, an octagon, etc. Although not absolutely essential, the base 30 should be shaped so as to reduce impacts exerted on the ice pulverizing knife upon rotation thereof, to ensure stability and durability of the latter. Irregular base shapes will result in a series of impact which is not desirable.

Figure 1A:
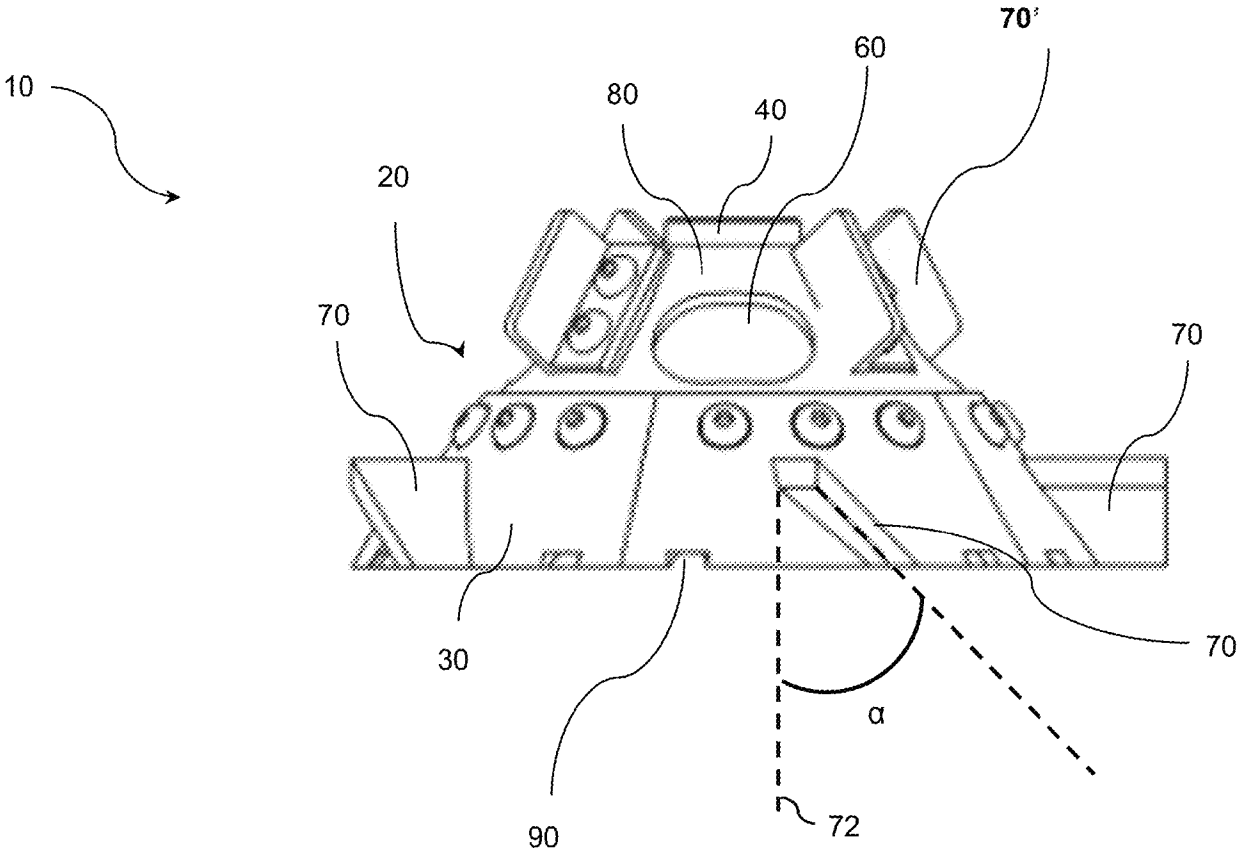
FIGS. 1A and 1B are a front elevation view of an ice pulverizing knife.
Figure 1B:
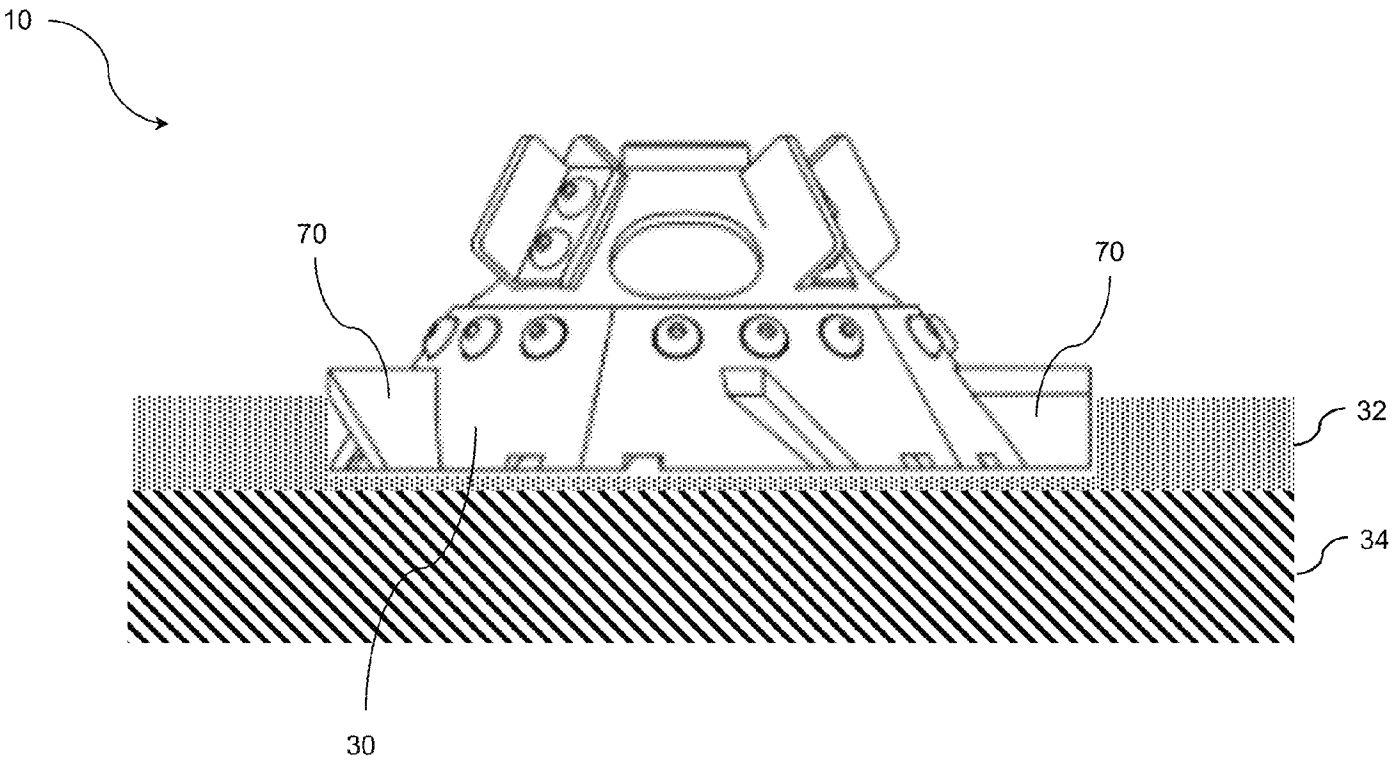
Figure 2:
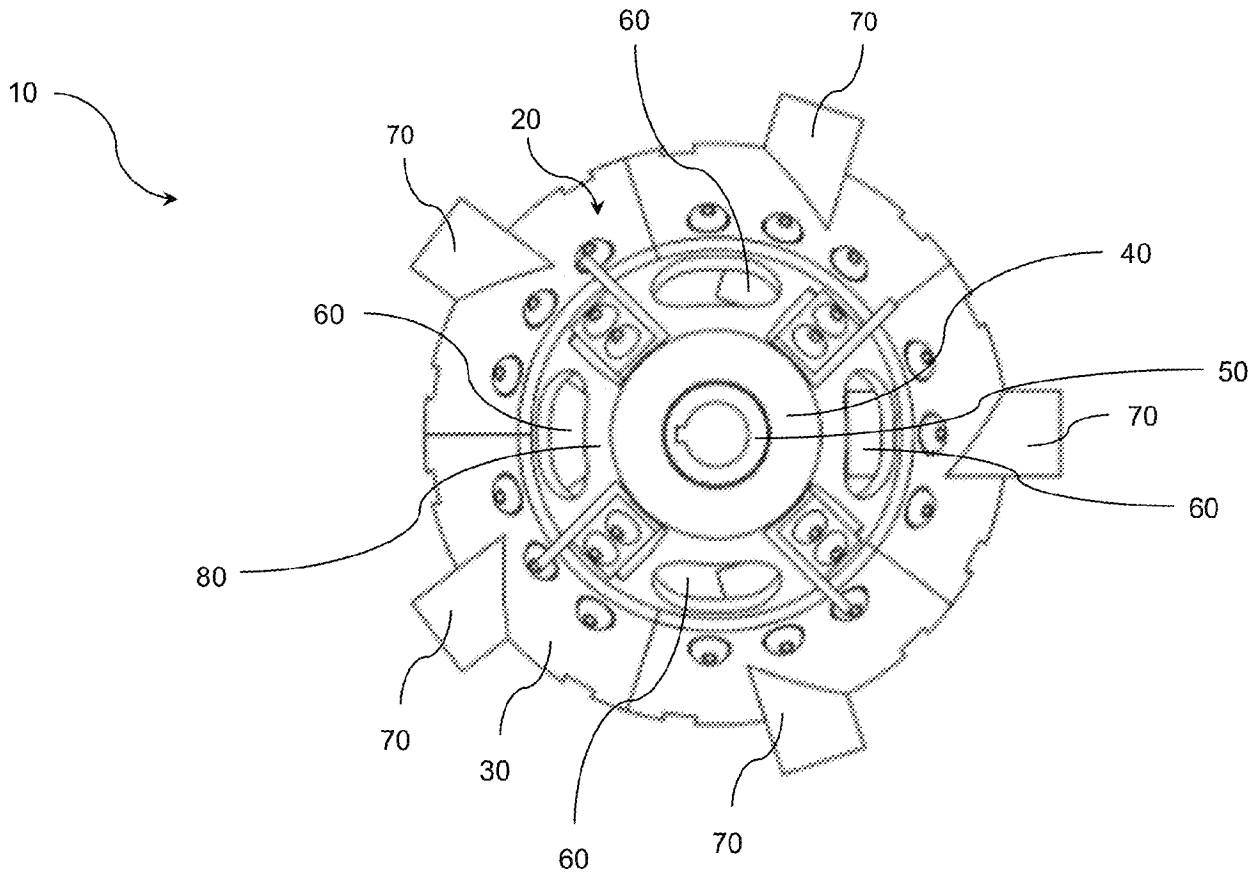
FIG. 2 is a top elevation view of the ice pulverizing knife of FIG. 1.
Figure 3:
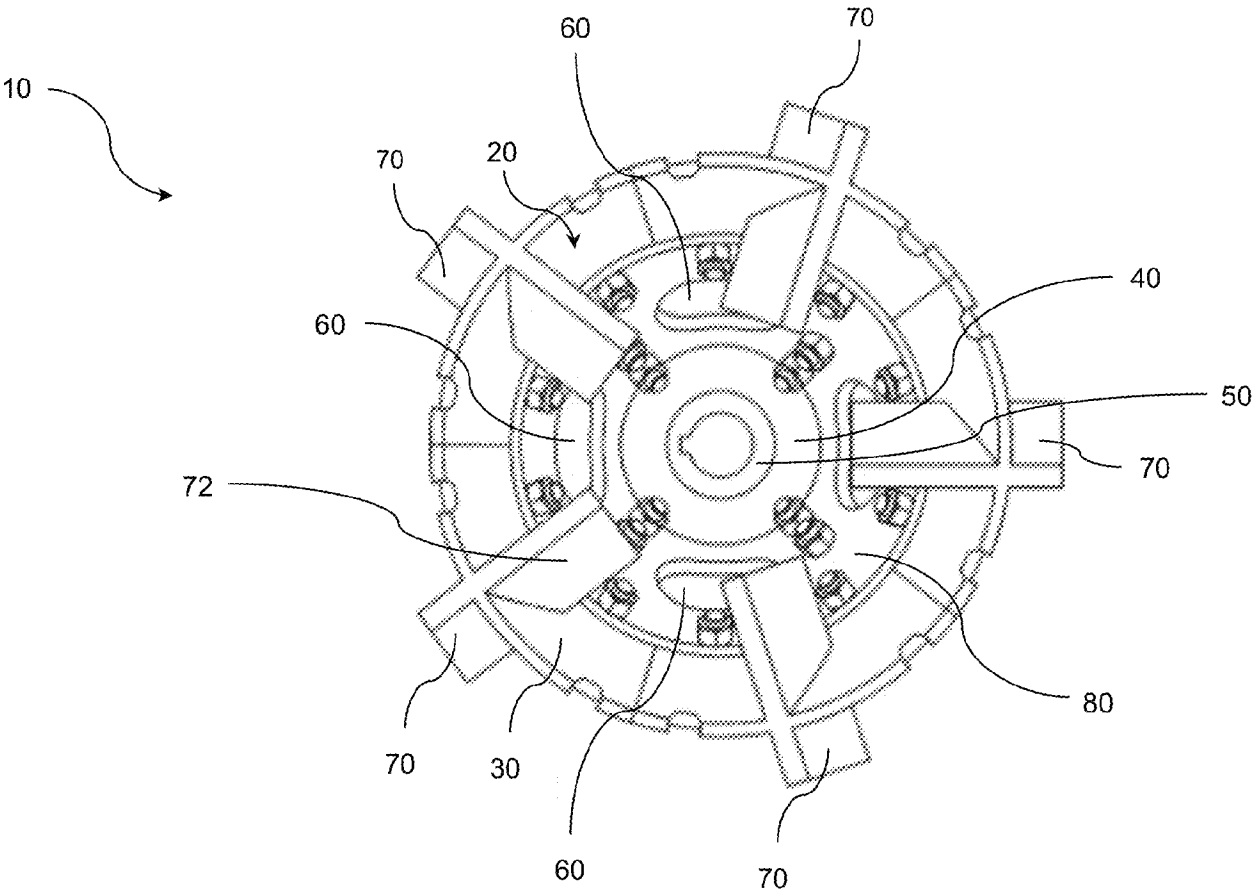
FIG. 3 is a bottom elevation view of the ice pulverizing knife of FIG. 1.

The base 30 engages with the ice on the ground surface. FIG. 1A illustrates the knife 10 alone; while FIG. 1B illustrates the knife 10 operating on a layer of ice 32 on the ground 34, with the base 30 engaging the layer of ice 32. The ground 34 may consist of a street, a sidewalk, a landing runaway, a parking lot, etc. Although the ice pulverizing knife 10 is shown on FIG. 1B as being within the layer of ice 32, those skilled in the art will understand that the ice pulverizing knife 10 may reach such a position only after it has been rotated long enough to pulverize the ice in the layer of ice 32 where it is located.

The frame 20 could be built with several interconnected components as shown on the Figures, or be molded into one piece. The frame 20 comprises a top 40 having or defining a socket 50. The socket 50 is adapted for mechanically coupling the frame 20 with a vertical drive shaft (not represented in the Figures). Rotation of the vertical drive shaft results in a circular rotation of the frame 20, and thus rotation of the ice pulverizing knife 10.

The ice pulverizing knife 10 comprises a plurality of blades 70. The plurality of blades 70 may be secured to the frame 20 or be part of the frame 20. When the blades 70 are secured to the frame 20, it is possible to replace one or several blades, while when the blades are part of the frame 20, it is necessary to replace the ice pulverizing knife when the blades 70 become too dull, broken or overused.

Figure 4:
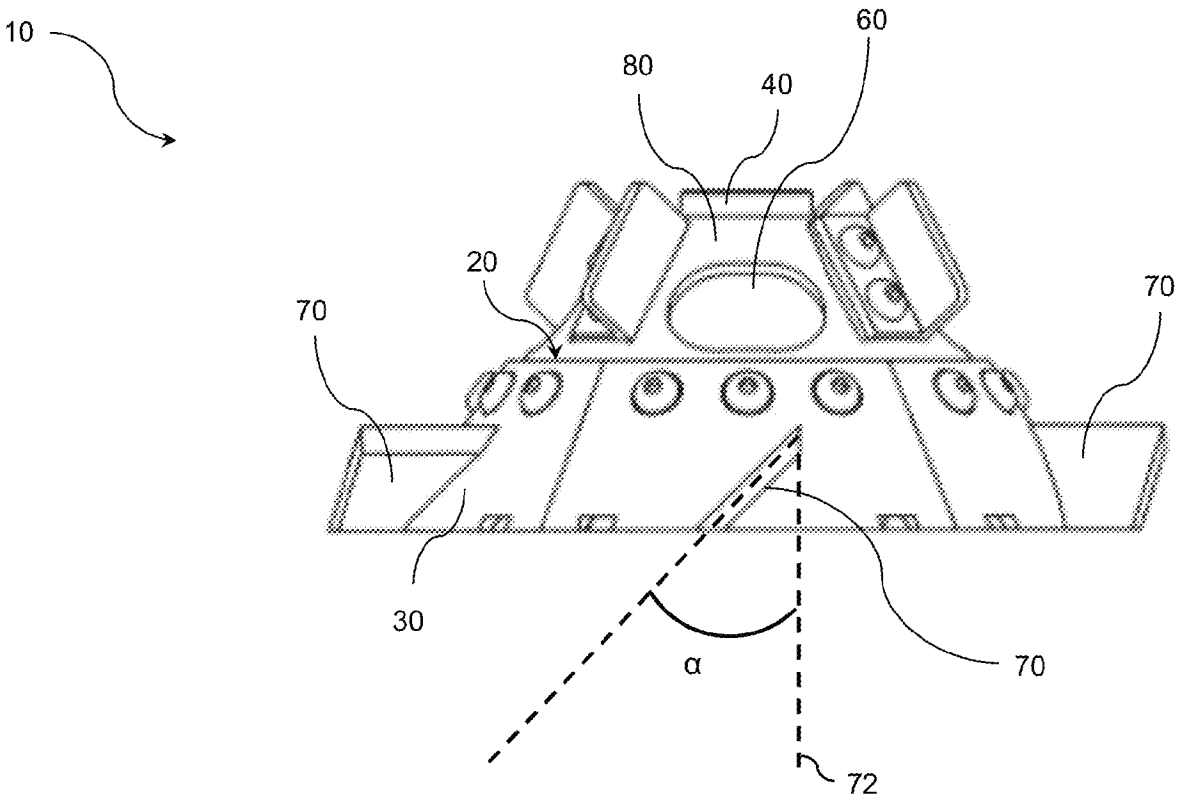
FIG. 4 is a front elevation view of the ice pulverizing knife, according to another embodiment.
Figure 5:
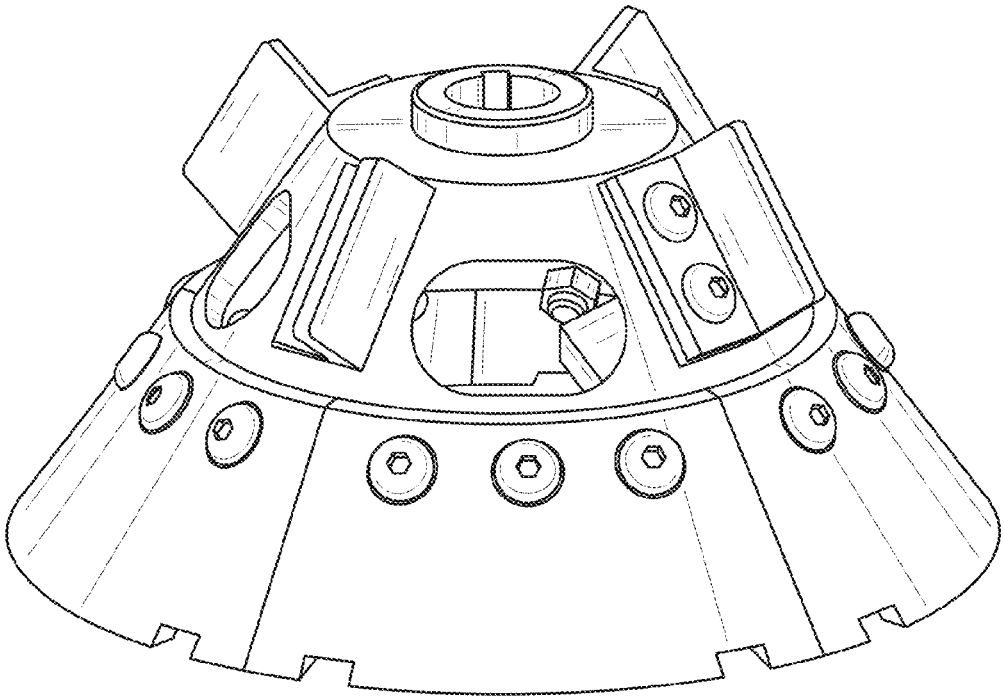
FIG. 5 is a front elevation view of an ice pulverizing knife in accordance with yet another embodiment.
Figure 6:
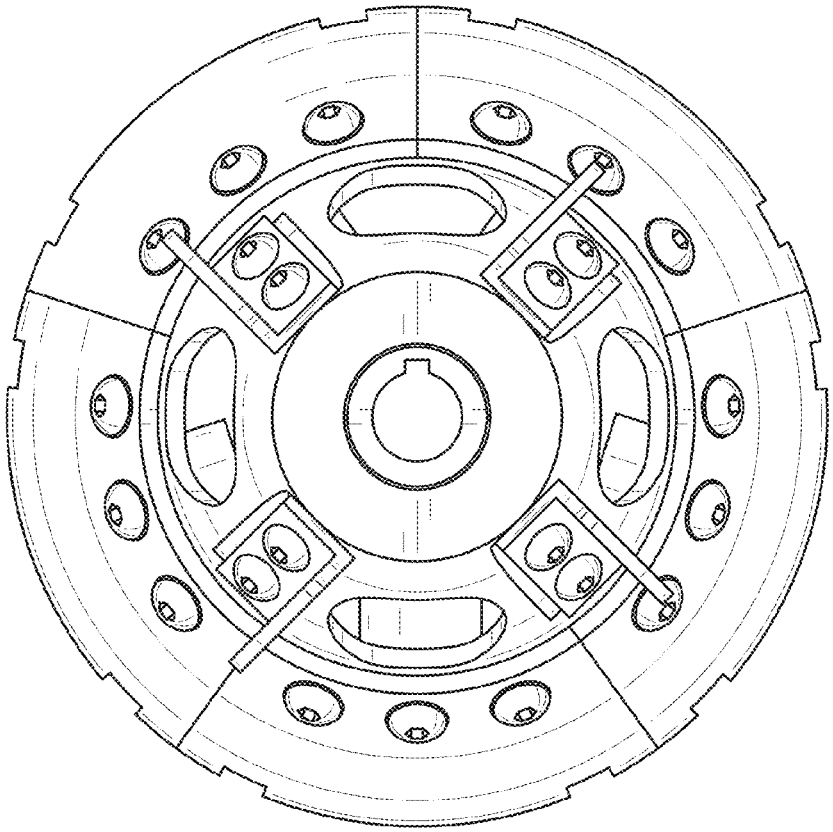
FIG. 6 is a top elevation view of the ice pulverizing knife of FIG. 5.
Figure 7:
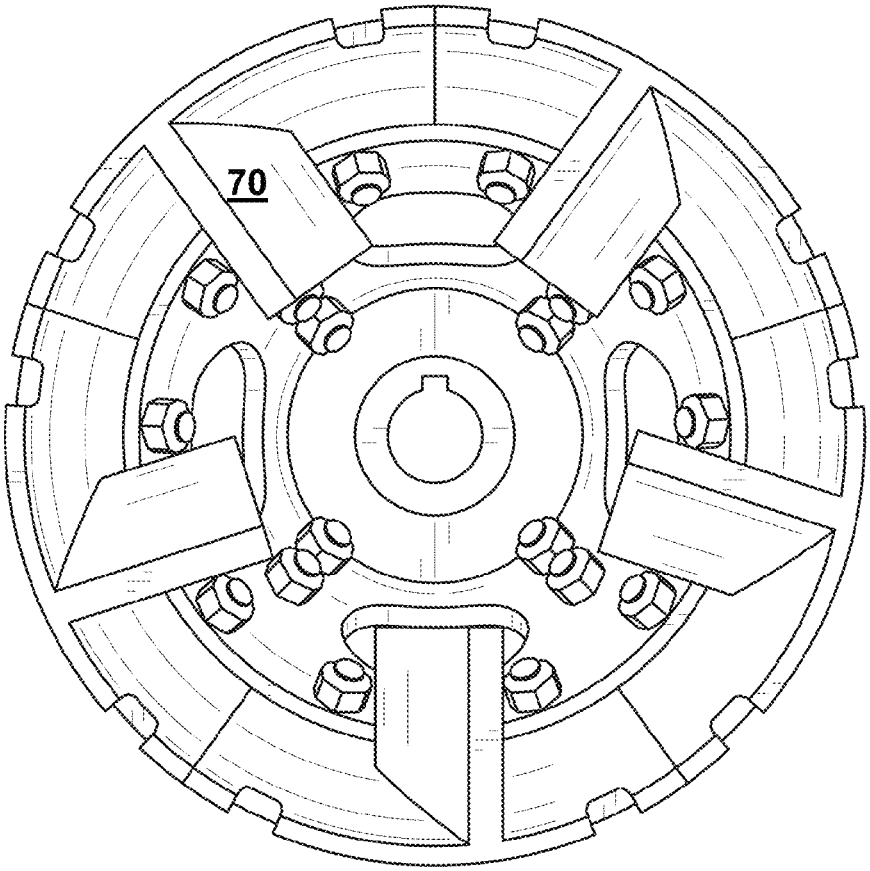
FIG. 7 is a bottom elevation view of the ice pulverizing knife of FIG. 5.

The blades 70 radially extend from the frame. The blades 70 may radially extend inside the frame 20 only as shown on FIG. 7, radially extend outside the frame 20 only as shown for example on FIG. 1A, radially extend partially inside and partially outside the frame 20 as shown on FIG. 3, or a combination thereof. The length of the blades radially extending from the frame 20 may vary, be identical. Alternately, the blades radially extending outside the frame 20 may be shorter or longer than the blades 70 radially extending within the frame 20. The blades 70 are positioned with respect to the base 30 of the frame 20 so as to provide engagement of each blade 70 with the ice on the ground surface for cutting the ice thereabout. Furthermore, the blades 70 do not extend below the base of the frame 20 so as to avoid damaging the surface under the layer of ice. The blades 70 are preferably positioned at a regular interval along the base of the frame 20, so as to provide even resistance on the drive shaft (not shown), and thereby avoid disbalancing of the ice pulverizing knife 10 or premature misalignment of the socket 50. The blades 70 may be made of a metal or alloy, or of any material very resistant to abrasion, such as for example steel, iron, i.e. any material that resists or tolerates abrasion with solid surfaces such as cement, concrete, asphalt, gravel, sand and the like. The blades 70 may be sharp or dull, depending on the type of material used. To increase their strength and efficiency, the blades 70 may be positioned at an angle $\alpha$ with respect to a center of the frame 20, as shown on FIG. 1A. When the ice pulverizing knife is to be used with a drive shaft turning in the clockwise direction, an angle $\alpha$ with respect to the center of the frame 20, as shown on FIG. 4 is recommended, while when the ice pulverizing knife is to be used with a drive shaft turning in the counterclockwise direction, an angle $\alpha$ with respect to a center of the frame 20, as shown on FIG. 1A is recommended.

FIG. 1B illustrates the result of the circular rotation of the blades 70, i.e. pulverizing the layer of ice 32 up to or almost up to the ground 34. Ice pulverized by the blades 70 radially extending inside of the frame 20 is expelled from the frame 20 thereby through at least one opening 60 between the top 40 and the base 30. Furthermore, upon displacement of the rotating ice pulverizing knife 10 along the ground 34, ice pulverized by the blades 70 radially extending outside of the frame 20 gradually enters the inside of the frame 20, and is also expelled through the at least one opening 60.

Although four openings are shown on the Figures, the present ice pulverizing knife 10 is not limited to such an implementation. Depending on the height of the frame 20, the number of blades 70 and the location of the blades 70 either inside and/or outside of the frame 20, a different number of openings 60 could be used. Alternately, some of the opening could be located at various height along the frame 20. When no blades 70 is present inside the frame 20, a scraper (not shown) could be used to help in expelling the pulverized ice outside of the frame 20 through the opening(s) 60.

The ice pulverizing knife 10 may further comprise a plurality of upper blades 70' on an upper portion of the frame 20. The upper blades 70' pulverize an upper portion of the layer of ice upon displacement of the rotating ice pulverizing knife 10 along the ground 34. The upper blades 70' may be disposed at a fixed interval around the frame 20. The upper blades 70' may be located above the blades 70, or in between blades 70. The upper blades 70' may be positioned at the angle $\alpha$ as previously discussed, or be aligned with a central line of the frame 20. There may be more, less or an equivalent number of upper blades 70' and blades 70. The upper blades 70' may be made of a similar material as the blades 70, or made of a different material. The upper blades 70' may be removable from the frame 20 as shown on the Figures, or made part of the frame 20.

The base of the frame 20 may further be provided with a series of notches 90. The notches 90 may be disposed around the base of the frame 20, and may engage the layer of ice. The notches 90 may groove the layer of ice, so as to further assist the blades 70 in pulverizing the ice.

In a particular aspect, each blade 70 is removably secured to the frame 20, to facilitate the replacement of worn out blades 70. Mechanisms for removably securing the blades 70 are well known in the art, and include for example hinges simultaneously secured to the blades 70 and to the frame 20 by means of screws and nuts. It may be preferable to have the securing mechanisms attached to the portion 72 (illustrated in FIG. 3) of each blade 70 extending inside the frame 20, to avoid a degradation of the performances of the ice removing function of the blades 70. Alternatively, slots (not represented in the Figures) may be provided in the frame 20 for inserting the blades 70. The slots may have a specific shape for maintaining the blades 70 engaged in the base 30 when in use for removing ice, while allowing disengagement of the blades 70 from the base 30 via a tool (e.g. a hammer) when not in use for removing ice. Other conventional methods of assembly may also be used.

In another particular aspect, each blade 70 is integral to the frame 20. For example, the blades 70 are welded to the frame 20. This configuration may provide a better resistance to the pressure exerted on the blades 70 while pulverizing ice compared to the removable blades previously discussed.

A configuration with five blades 70 radially extending partly inside and partly outside of the frame rotating at 500 rpm or higher has been tested, with blades positioned at an angle $\alpha$ of 45 degrees and four openings has provided excellent results in terms of ice pulverizing efficiency, balance of the frame 20 and resistance to the pressure exerted on the blades 70 while pulverizing ice. The tested configuration pulverized ice layers of up to 5 inches thick, transforming pure ice into snow. The rotating ice pulverizing knife 10 was displaced along the ground surface 34 at a speed of 5 mph.

Depending on the selected implementation, the frame 20 may be integrally made of a single material moulded to the proper shape. Alternatively, the base 30 may be made separately and assembled with the rest of the frame 20, to become an integral part of the frame 20. For example, the base 30 may be welded to the rest of the frame 20. Alternatively, hinges may be simultaneously secured to the base 30 and to the rest of the frame 20 by means of screws and nuts. Other conventional methods of assembly may also be used. Similarly, the top 40 may be made separately and assembled with the rest of the frame 20, to become an integral part of the frame 20. The frame 20 may be integrally made of a metal, for example steel. Alternatively, different parts of the frame 20 (e.g. the based 30 and/or the top 40) may be made of different materials having specific characteristics adapted to the functionalities of each particular parts.

Figure 8:
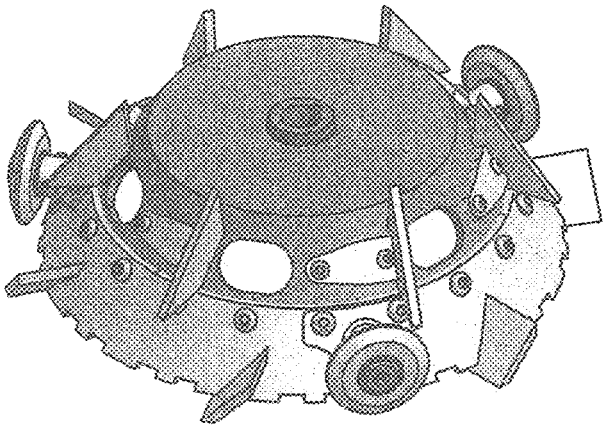
FIG. 8 is a front elevation view of the ice pulverizing knife according to yet another embodiment.

In another aspect shown on FIG. 8, the ice pulverizing knife is further provided with rotating wheels 90 along its base, so as to better protect the ground surface on which the rotating ice pulverizing knife 10 is used. The rotating wheels may be made of metal, rubber, or any other appropriate material. The rotating wheels 90 may be fixed to the base 30, or may be thereto attached.

Figure 9A:
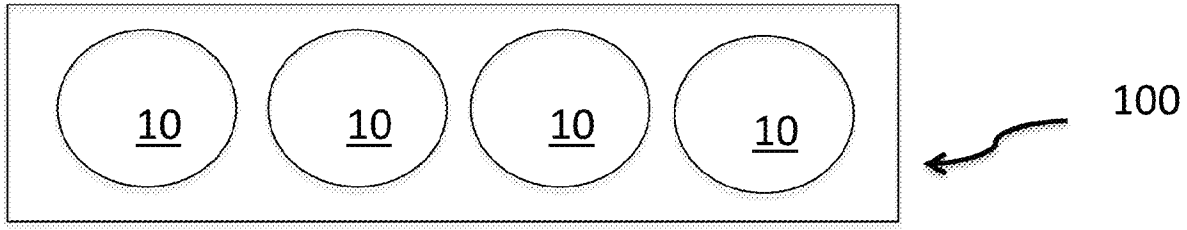
FIG. 9A is a bottom view of a ice pulverizing device in accordance with a first aspect.
Figure 9B:
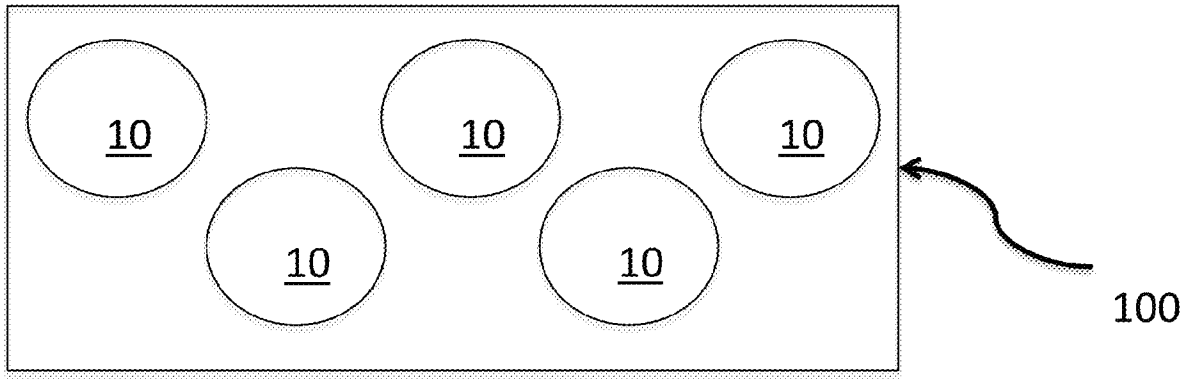
FIG. 9B is a bottom view of the ice pulverizing device in accordance with a second aspect.

Reference is now made concurrently to FIGS. 9A and 9B, which are exemplary bottom views of different aspects of an ice pulverizing device 100. The ice pulverizing device 100 includes at least one ice pulverizing knife 10. As shown on FIG. 9A, the ice pulverizing device 100 includes four ice pulverizing knives 10 in linear alignment perpendicular to a direction 110 of movement of the ice pulverizing device 100. FIG. 9B depicts five ice pulverizing knives 10 positioned in two rows aligned perpendicular to the direction 110 of movement of the ice pulverizing device 100. The ice pulverizing device 100 may include any number of ice pulverizing knives 10 in order to cover the area from which the ice needs to be pulverized. For example, the ice pulverizing device 100 may include a number of ice pulverizing knives 10 positioned so as to pulverize ice over a width corresponding to the width of the tractor or vehicle with which it is used. For example, in the case of sidewalk snow removal vehicles, the ice pulverizing device 100 may include 2 or 3 ice pulverizing knives 10 pulverizing ice over a width of the sidewalk snow removal vehicle. In another example, the ice pulverizing device 100 may be added to a vehicle for removing snow and ice from streets, and may include 6-10 ice pulverizing knives 10 positioned in one or two rows, and pulverizing ice over a width of the vehicle or a snow removal blade thereof.

The ice pulverizing device 100 may be presented as an implement to be used with a tractor or a vehicle. In such a case, the ice pulverizing device 100 is equipped with a power transmission coupler, such as for example a Power Take Off (PTO) coupler, acting as a propulsion mechanism for rotating the ice pulverizing knives 10. Any type of power transmission coupler could be used, so as to transfer power generated by the tractor or vehicle to the ice pulverizing device 100 to actuate rotation of the ice pulverizing knives 10.

In another aspect, the ice pulverizing device 100 may be provided as a vehicle which include the ice pulverizing knives 10 and the propulsion mechanism. In that case, the propulsion mechanism is mechanically coupled to the drive shaft which is inserted in the socket of the ice pulverizing knives 10. The vehicle is further provided with an engine for displacing the vehicle and therewith the rotating ice pulverizing knives 10 along the ground surface.

Figure 10:
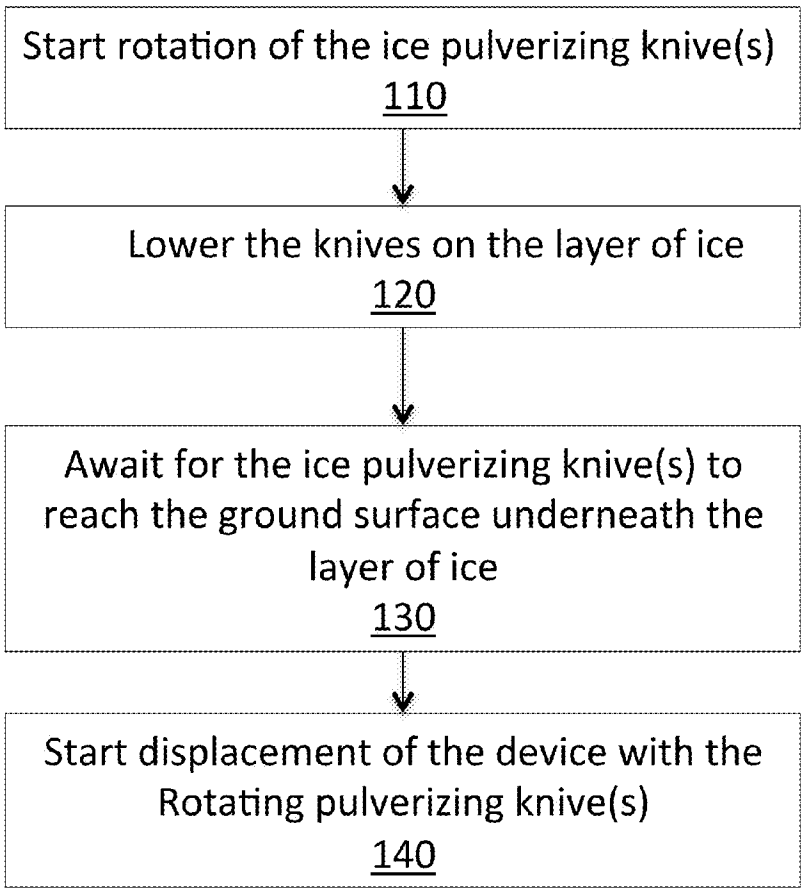
FIG. 10 is a flow diagram of a method of operating the ice pulverizing device.

Reference is now made to FIG. 10, which is a flowchart describing the method of operating the present ice pulverizing device. The method starts with actuating the rotation of the ice pulverizing knives. The method then continues with lowering the ice pulverizing knives on the layer of ice. The method then awaits for the ice pulverizing knives to pulverize the ice so as to reach the ground surface thereunder. The method continues with displacing the ice pulverizing knives along the ground. When the area of ice on the ground has been pulverized, rotation of the ice pulverizing knives is stopped and the ice pulverizing knives are lifted from the ground.

Although the present ice pulverizing knife and device have been described in the foregoing description by way of illustrative embodiments thereof, these embodiments can be modified at will, within the scope of the appended claims.

What is claimed is:

1. An ice pulverizing knife for pulverizing ice from a ground surface, the ice pulverizing knife comprising:

a frame having a substantially circular base defining a first diameter, the frame comprising:

a top defining a second diameter smaller than the first diameter, the top having a socket, the socket being adapted for mechanically coupling the frame with a vertical drive shaft, a rotation of the vertical drive shaft resulting in a circular rotation of the frame, the base for engaging with the ice on the ground surface, and at least one opening between the top and the base; and a plurality of blades secured to the frame, each blade radially projecting away from-the frame radially along the base, each blade engaging with the ice on the ground surface for cutting the ice;

wherein ice cut by the blade and accumulated inside the frame is expelled from the frame through the at least one opening.

2. The ice pulverizing knife of claim 1, wherein each blade is removably secured to the frame.

3. The ice pulverizing knife of claim 1, wherein each blade is integral to the frame.

4. The ice pulverizing knife of claim 1, wherein the blades are uniformly distributed along the base of the frame, and radially extend inside of the frame.

5. The ice pulverizing knife of claim 1, wherein the blades are uniformly distributed along the base of the frame, and radially extend outside out of the frame.

6. The ice pulverizing knife of claim 1, wherein the blades are uniformly distributed along the base of the frame, and radially extend partially inside and partially outside of the frame.

7. The ice pulverizing knife of claim 1, comprising five blades.

8. The ice pulverizing knife of claim 1, wherein the blades are oriented at a specific angle with respect to a vertical axis.

9. The ice pulverizing knife of claim 8, wherein the specific angle is adapted to a clockwise circular rotation of the frame.

10. The ice pulverizing knife of claim 8, wherein the specific angle is adapted to a counterclockwise circular rotation of the frame.

11. The ice pulverizing knife of claim 8, wherein the specific angle is substantially 45 degrees.

12. The ice pulverizing knife of claim 1, wherein the openings are uniformly distributed along a surface of the frame proximate to the top.

13. The ice pulverizing knife of claim 1, comprising four openings.

14. An ice pulverizing device for pulverizing ice from a ground surface, the ice pulverizing device comprising:

at least one ice pulverizing knife in accordance with claim 1; and a propulsion mechanism comprising the vertical drive shaft, the socket of the at least one ice pulverizing knife being mechanically coupled with the vertical drive shaft, whereby upon rotation of the vertical drive shaft, the at least one ice pulverizing knife rotates.

15. The ice pulverizing device of claim 14, wherein the at least one ice pulverizing knife and the propulsion mechanism are part of an implement.

16. The ice pulverizing device of claim 14, wherein the at lest one ice pulverizing knife and the propulsion mechanism are part of a vehicle.

17. The ice pulverizing device of claim 14, wherein the propulsion mechanism is a Power Take Off (PTO) Coupler.

18. The ice pulverizing device of claim 14, further comprising a vertical adjustment mechanism for lifting and lowering the at least one ice pulverizing knife with respect to the ice on the ground surface.

19. The ice pulverizing device of claim 18, further comprising a propulsion mechanism for moving substantially horizontally the at least one ice pulverizing knife on the ground surface while the at least one ice pulverizing knife is rotating.

* * * * *